United States Patent [19]

Nakano et al.

[11] 3,991,711

[45] Nov. 16, 1976

[54] ELECTROSTATIC DUPLICATING METHOD AND APPARATUS UTILIZING WET-DEVELOPING

[75] Inventors: Keita Nakano, Yokohama; Takuzo Tsukamoto, Chigasaki, both of Japan

[73] Assignee: Fuji Xerox Co., Ltd., Tokyo, Japan

[22] Filed: Oct. 11, 1973

[21] Appl. No.: 405,504

[30] Foreign Application Priority Data

Oct. 11, 1972 Japan ..... 47-101120

[52] U.S. Cl. ..... 118/637; 118/DIG. 23; 355/10

[51] Int. Cl.[2] ..... G03G 15/10

[58] Field of Search ..... 118/DIG. 23, 637; 355/3 P, 10; 96/1 LY; 29/132

[56] References Cited

UNITED STATES PATENTS

| | | | |
|---|---|---|---|
| 3,276,896 | 10/1966 | Fisher | 118/637 |
| 3,611,028 | 10/1971 | Whitmore | 29/132 |
| 3,712,728 | 1/1973 | Whittaker | 355/10 |
| 3,776,723 | 12/1973 | Royka et al. | 118/637 |
| 3,817,748 | 6/1974 | Whittaker | 96/1 LY |
| 3,863,603 | 2/1975 | Buckley et al. | 118/637 |

*Primary Examiner*—Mervin Stein
*Assistant Examiner*—Douglas Salser
*Attorney, Agent, or Firm*—Gerald J. Ferguson, Jr.; Joseph J. Baker

[57] ABSTRACT

Apparatus for wet-developing an electrostatic latent image comprising an electroconductive, ink supply member having an uneven surface comprising a plurality of raised portions and depressions below the raised portions, at least the surface of the ink supply member being electroconductive; means for supplying ink to the ink supply member so that the ink is held in the depressions; an electrophotographic member bearing the electrostatic latent image; and elastic, electroconductive support member for the electrophotographic member; and means for bringing the ink supply member and the electrophotographic member into substantial contact with one another so that the ink is attracted to the electrostatic latent image to thereby develop the image while minimizing damage to the electrophotographic member because of the elasticity of said elastic support member.

6 Claims, 2 Drawing Figures

ELECTROSTATIC DUPLICATING METHOD AND APPARATUS UTILIZING WET-DEVELOPING

CROSS REFERENCE TO RELATED APPLICATION

This application is related to a copending United States patent application filed by the inventors of the instant application on even data herewith, entitled "Improved Electrostatic Duplicating Process Utilizing Wet-Developing." The copending application is hereby incorporated herein by reference.

BACKGROUND OF THE INVENTION

1. Field of the Invention

The present invention relates to an electrostatic duplicating process and apparatus and, in particular, to the improved development of electrostatic latent images in such processes and apparatus.

The term "electrostatic duplicating process" as used herein in this specification includes all duplicating processes which include the formation of an electrostatic latent image. For example, there would be included electrophotographic duplicating processes where an electrostatic latent image is formed by electrifying the surface of a photoconductor and subjecting it to imagewise exposure; electrostatic recording processes where an electrostatic latent image is formed by scanning the surface of a dielectric with a needle electrode; duplicating processes where an electrostatic latent image is formed by imagewise exposing a photoconductor while applying thereto a by-pass electric potential and the like.

2. Description of the Prior Art

Heretofore, electrostatic latent images on a photoconductive member have been developed with ink-supplying members having a fine, uneven peripheral portion such as disclosed in U.S. Pat. No. 3,084,043 (which is incorporated herein by reference) and Japanese Pat. Publication No. 9512/69. In such processes, liquid ink is held in the depressions formed on the ink-supplying member, and the raised portions thereof are positioned against or close to the surface of the electrostatic latent image-bearing photoconductive member, whereby the ink in the depressions is transferred via the raised portions to the surface bearing the electrostatic latent image by the electrostatic attracting force of the electrostatic charge on the photoconductive member to develop the latent image. The ink-supplying member may be prepared by forming slots or grooves, for example, on the surface of a hard, electroconductive substance such as an iron pipe or by forming hardened resin dot patterns on a metal plate. Since the ink-supplying member is in physical contact with the photoconductive member or can contact it if positioned close thereto, the surface of the photoconductive member is subject to damage, which in turn results in image quality deterioration.

SUMMARY OF THE INVENTION

A primary purpose of the present invention is to overcome the defects of the prior art where an electroconductive elastomer is employed as the support for a light sensitive layer so that excess force produced by an ink-supplying member is absorbed upon development to thereby prevent the surface of the light-sensitive layer from being damaged and thus improve the distinctness of the impressions obtained.

The present invention thus relates to an electrostatic duplicating apparatus and process, which comprises optionally providing a fine uneven surface on an elastomer having electroconductivity at least at the surface thereof to thereby provide an ink-supply member. Liquid ink is supplied to said ink-supply member so that the ink is held in the depressions or valleys formed on the ink-supply member. The raised portions of the ink-supplying member are then brought into contact with the electrostatic latent image-bearing surface of a light-sensitive member, which comprises a light-sensitive layer disposed on the surface of an electroconductive, elastic support. Thus the liquid ink held in the depressions is supplied to the latent image-bearing surface via the raised portions of the ink-supplying member due to the electrostatic attracting action of the electrostatic charge on the light-sensitive layer. A thin metallic layer may also be disposed between the electroconductive, elastic support and the light-sensitive layer.

Other objects and advantages of this invention will become apparent upon reading the appended claims in conjunction with the following detailed description and the attached drawing.

DETAILED DESCRIPTION OF PREFERRED EMBODIMENTS OF INVENTION

Figure 1:
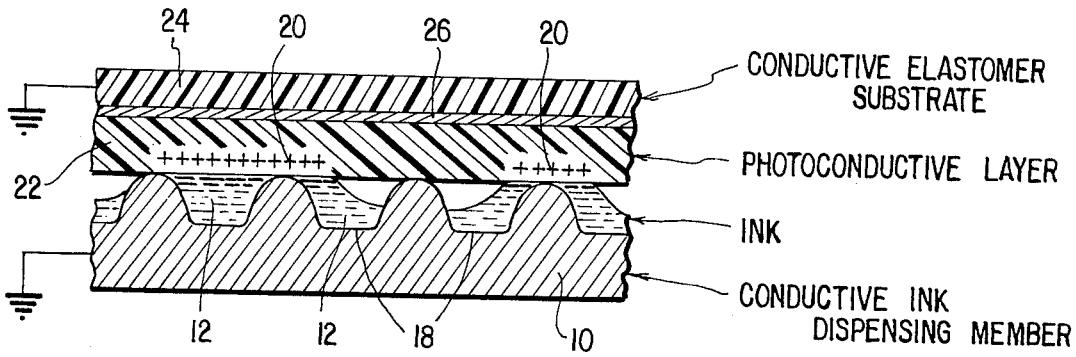
FIG. 1 is a diagrammatic view of an ink-supplying member applying ink to an illustrative embodiment of an electrophotographic member in accordance with this invention.
Figure 2:
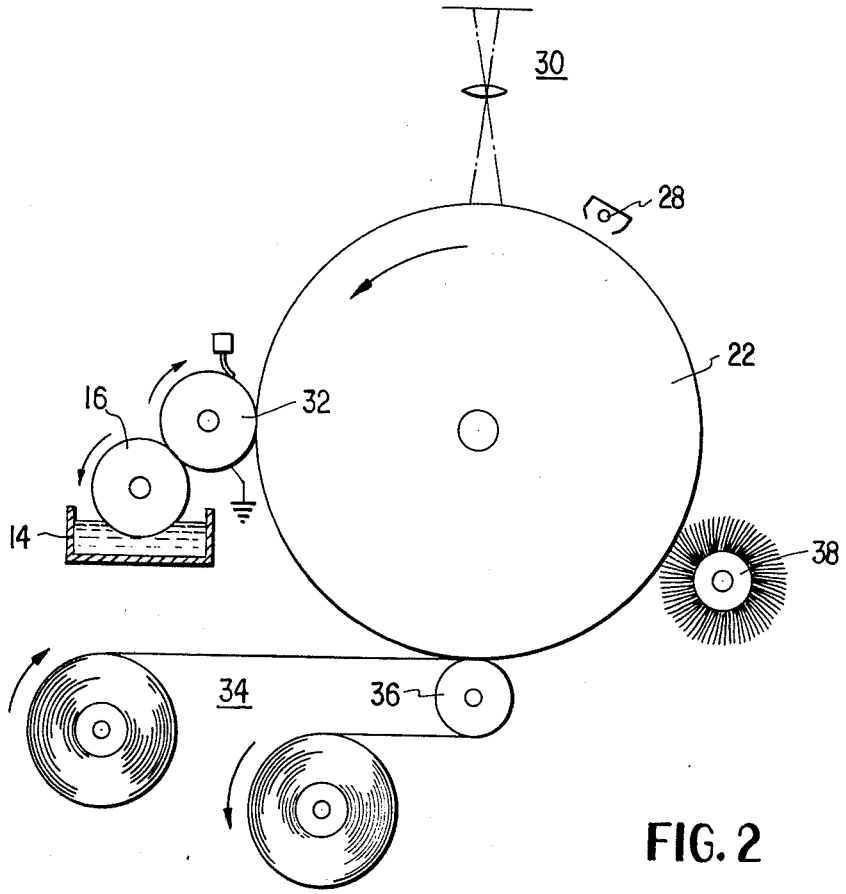
FIG. 2 is a diagrammatic view of an electrophotographic apparatus utilizing the wet-developing process of this invention.

Referring to FIGS. 1 and 2, various illustrative embodiments of the invention will now be described.

An ink-supply member 10 is provided which may be inelastic (as shown in FIG. 1) or elastic (as provided in the beforementioned copending application) and have a fine, uneven surface. Thus, ink-supply member 10 may comprise an elastomer having electroconductivity at least at the surface thereof. A liquid ink 12 is supplied to the ink-supply member 10 by ink-supplying means (typically comprising ink container 14 and inking roller 16) to the depressions or valleys 18 formed on the ink-supplying member. The raised portions of the ink-supplying member are brought into contact with the electrostatic latent image-bearing surface a light-sensitive member, which comprises a light-sensitive layer 22 on the surface of an electroconductive elastic support 24, which may be grounded. The liquid ink thus held in the depressions 18 is supplied to the latent image-bearing surface via the raised portions of the ink-supply member 10 by the electrostatic attracting action of the electrostatic charge on the light-sensitive layer 22. A thin metallic layer 26 may be provided between the electroconductive, elastic support 24 and the light-sensitive layer 22. Since the latent image-forming surface of the light-sensitive member is supported by an elastomer, there is little, if any, probability of the surface of the light-sensitive layer 22 being damaged upon contact with the ink-supply member 10. Thus, the durability of the light-sensitive layer 22 is greatly enhanced and, in addition, the distinctness of the resulting image is markedly improved. The resistivity of the electroconductive elastic support 24 should be greater than $10^{10}$ ohm.cm and preferably no greater than $10^6$ ohm.cm and the thickness should be sufficient to provide elasticity and should be at least 1 mm.

Several illustrative examples of the invention will now be described, there being no intent to limit the scope thereof.

EXAMPLE 1

Silicone rubber having a Shore hardness of 75° and electric resistivity of $1 \times 10^3$ ohm.cm was utilized as support member 24 and wound around an aluminum pipe of 200 mm. outside diameter and 300 mm. width in a thickness of 10 mm. A photoconductive substance of cadmium sulfide was utilized as the light-sensitive layer 22 and coated the pipe to a thickness of 40 $\mu$ to prepare a light-sensitive member. An electrostatic latent image 20 was formed thereon in a conventional manner such as by uniform charging means 28 and image exposing means 30 of FIG. 2. Separate slots of 0.1 mm. in pitch and 0.1 mm. in depth were formed on the surface of an iron pipe of 40 mm. outside diameter to thereby provide an ink-supply member 10. Liquid ink was supplied to the slots formed on the ink-supply member. After removing excess ink by a doctor blade 32, the ink-supply member 10 was brought into substantial contact with the surface of light-sensitive member 22 to effect development. In this instance, it is not necessary to mechanically bring the two members into contact with each other, but it is sufficient to position them close enough to each other for the liquid ink to move from one to the other. Thus, even in the foregoing instance, the ink-supply member and the light-sensitive member can be considered to be in "substantial contact" with one another for the purposes of this specification and claims. Even when the members are not in physical contact, there is a high probability that the ink-supply member and the light-sensitive member will physically contact each other and thus damage the light-sensitive member. However, since an elastic support member 24 is provided for the light-sensitive member 22, no damage of the light sensitive member is observed and images of high quality are formed on the photoconductive surface.

The ink-supply member 10 may be replaced by one which is prepared by winding an elastomer, which has electroconductivity at least at the surface layer, around an iron pipe and having a fine uneven portion over the entire surface of the elastomer. In this case, both the light-sensitive member and the ink-supplying member possess elasticity and damage to the light-sensitive member can be further reduced.

EXAMPLE 2

Silicone rubber having a Shore hardness of 75° and a resistivity of $1 \times 10^3$ ohm.cm was wound around an aluminum pipe of 200 mm. outside diameter and 300 mm. width in a thickness of 10 mm. Nickel (corresponding to layer 26) was plated thereon in a thickness of 5 $\mu$, and selenium was further vacuum deposited thereon in a thickness of 80 $\mu$ to prepare the light-sensitive member on which an electrostatic latent image was formed in a conventional manner. Thereafter, liquid ink was supplied to the ink slots formed on the ink-supplying member made of iron pipe described in Example 1, and this ink-supplying member was brought into contact with the surface of the above-described light-sensitive member. There was obtained a good image on the photoconductive surface without damaging the selenium layer on the surface of the light-sensitive member.

EXAMPLE 3

Silicone rubber having a Shore hardness of 75° and electric resistivity of $1 \times 10^3$ ohm.cm was wound around an aluminum pipe of 200 mm. outside diameter and 300 mm. width in a thickness of 10 mm. Nickel was plated thereon in a thickness of 5 $\mu$, and a photoconductive surface of cadmium sulfide was further coated thereon in a thickness of 40 $\mu$ to prepare the light-sensitive member on which an electrostatic latent image was formed in a usual manner. Thereafter, liquid ink was supplied to the slots formed on the ink-supply member made of iron pipe described in Example 1, and this ink-supply member was brought into contact with the surface of the above-described light-sensitive member. There was obtained a more distinct image than in Example 1 without damaging the surface of the light-sensitive member of cadmium sulfide.

EXAMPLE 4

Urethane rubber having a Shore hardness of 75° and electric resistivity of $1 \times 10^3$ ohm.cm was used instead of the silicone rubber used in Example 1, and a photoconductive substance of cadmium sulfide was coated thereon in a thickness of 40 $\mu$ to prepare the light-sensitive member, to which liquid ink was applied by the same ink-supplying member as described in Example 1. There was obtained the same image quality as in Example 1 with no damage to the photoconductive layer.

In all of the above-described Examples, image quality can be stabilized by electrically grounding the ink-supply member 10, and further a more improved image can be obtained by pressing, upon transferring at station 34, the transfer paper by a rubber roller 36. The above operations can then be repeated at cleaning at station 38.

The liquid ink used in each of the foregoing examples typically has a volume resistance of $1 \times 10^5$ to $1 \times 10^{15}$ ohm.cm and a viscosity of from about 100 cps. to about 10,000 cps. and comprises a single phase. Examples of the composition are as follows:

| | | |
|---|---|---|
| (A) | Polypropylene glycol (molecular weight: 1025) | 60 % by weight |
| | Microlith CT Black (predispersed carbon black, made by Ciba Limited) | 25 % by weight |
| | Rucoflex TG-8 (triethylene glycol dicaprilate, made by Hooker Chemical Co.) | 15 % by weight |
| (B) | Light liquid paraffin | 45 % by weight |
| | Microlith CT Black (same as in (A)) | 25 % by weight |
| | Ganex V-216 (alkylated polyvinylpyrrolidone, made by General Anyline | 25 % by weight |
| | Solid paraffin | 5 % by weight |

Numerous modifications of the invention will become apparent to one of ordinary skill in the art upon reading the foregoing disclosure. During such a reading, it will be evident that this invention provides a unique apparatus and method utilizing wet-developing for accomplishing the objects and advantages hereinstated.

What is claimed is:

1. Apparatus for wet-developing an electrostatic latent image comprising an electroconductive ink-supply member having an uneven surface comprising a plurality of raised portions and depressions below said raised portions, at least the surface of said ink-supply member being electroconductive;

means for supplying ink to said ink-supply member so that the ink is held in said depressions;

an electrophotographic member bearing said electrostatic latent image;

an elastic, electroconductive support member for said electrophotographic member, said electrophotographic member being fixedly disposed with respect to said elastic, electroconductive support member; and means for bringing the ink-supply member and the electrophotographic member into substantial contact with one another so that said ink is attracted to said electrostatic latent image to thereby develop the image while minimizing damage to the electrophotographic member because of the elasticity of said elastic support member.

2. Apparatus as in claim 1 wherein the resistivity of said elastic, electroconductive support member is no greater than $10^{10}$ ohm.cm.

3. Apparatus for wet-developing an electrostatic latent image comprising an electroconductive ink-supply member having an uneven surface comprising a plurality of raised portions and depressions below said raised portions, at least the surface of said ink-supply member being electroconductive, said ink-supply member including an elastic, outer portion, said uneven surface being disposed on the surface of said outer portion and at least the surface of said outer portion being electroconductive;

means for supplying ink to said ink-supply member so that the ink is held in said depressions;

an electrophotographic member bearing said electrostatic latent image;

an elastic, electroconductive support member for said electrophotographic member; and means for bringing the ink-supply member and the electrophotographic member into substantial contact with one another so that said ink is attracted to said electrostatic latent image to thereby develop the image while minimizing damage to the electrophotographic member because of the elasticity of said elastic support member.

4. Apparatus as in claim 3 where said elastic, electroconductive support member is electrically grounded.

5. Apparatus as in claim 3 where the resistivity of said elastic outer portion of the ink-supply member is no greater than $10^{10}$ ohm.cm.

6. Apparatus for wet-developing an electrostatic latent image comprising an electrically grounded, electroconductive ink-supply member having an uneven surface comprising a plurality of raised portions and depressions below said raised portions, at least the surface of said ink-supply member being electroconductive;

means for supplying ink to said ink-supply member so that the ink is held in said depressions;

an electrographic member bearing said electrostatic latent image;

an elastic electroconductive support member for said electrophotographic member; and means for bringing the ink-supply member and the electrophotographic member into substantial contact with one another so that said ink is attracted to said electrostatic latent image to thereby develop the image while minimizing damage to the electrophotographic member because of the elasticity of said elastic support member.

* * * * *